US007512362B2

(12) United States Patent
Park

(10) Patent No.: US 7,512,362 B2
(45) Date of Patent: Mar. 31, 2009

(54) PHOTOSENSITIVE DRUM WITH IMPROVED SHUTTER STRUCTURE AND IMAGE FORMING APPARATUS HAVING THE SAME

(75) Inventor: Jong-hyun Park, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 294 days.

(21) Appl. No.: 11/369,832

(22) Filed: Mar. 8, 2006

(65) Prior Publication Data

US 2007/0003320 A1 Jan. 4, 2007

(30) Foreign Application Priority Data

Jun. 30, 2005 (KR) ..... 10-2005-0057924

(51) Int. Cl.
*G03G 21/18* (2006.01)

(52) U.S. Cl. ..... 399/114; 399/107; 399/110; 399/111; 399/116; 399/117

(58) Field of Classification Search ..... 399/114, 399/116, 107, 110, 111, 117
See application file for complete search history.

(56) References Cited

U.S. PATENT DOCUMENTS 6,470,159 B2 * 10/2002 Dycher ..... 399/114
6,560,425 B1 5/2003 Lui et al.
2003/0156856 A1 * 8/2003 Arimitsu et al. ..... 399/114

FOREIGN PATENT DOCUMENTS

| | | |
|---|---|---|
| JP | 11-202730 | 7/1999 |
| JP | 2000-321955 | 11/2000 |
| JP | 2002-62761 | 2/2002 |
| KR | 2002-16389 | 3/2002 |

OTHER PUBLICATIONS

Office Action issued on Sep. 19, 2006 from Korean Intellectual Property Office for Korean Patent Application No. KR 2005-57924.

* cited by examiner

*Primary Examiner*—David M Gray
*Assistant Examiner*—Ryan D Walsh
(74) *Attorney, Agent, or Firm*—Stein, McEwen & Bui, LLP

(57) ABSTRACT

A photosensitive drum unit includes a photosensitive drum, a shutter having a rotation axis shaft which opens and closes to selectively enable access to the photosensitive drum, and a coupler, wherein a linear motion thereof causes a rotational motion of the shutter about the rotation axis shaft. The coupler is coupled to a rotation axis shaft of the shutter and is capable of changing a straight line motion to a rotational motion in a narrow space. In an image forming apparatus equipped with the photosensitive drum unit of the invention, a pressing unit mounted at a support frame of the photosensitive drum unit is pressably engageable with the coupler.

20 Claims, 11 Drawing Sheets

PHOTOSENSITIVE DRUM WITH IMPROVED SHUTTER STRUCTURE AND IMAGE FORMING APPARATUS HAVING THE SAME

CROSS-REFERENCE TO RELATED APPLICATIONS

This application claims the benefit of Korean Patent Application No. 2005-57924, filed Jun. 30, 2005, in the Korean Intellectual Property Office, the disclosure of which is incorporated herein by reference.

BACKGROUND OF THE INVENTION

1. Field of the Invention

Aspects of the present invention relate in general to an image forming apparatus, and more specifically, to a photosensitive drum with an improved shutter structure and an image forming apparatus having the same.

2. Description of the Related Art

In general, an image forming apparatus such as a laser printer, a copy machine, a scanner, a fax machine, etc., has a photosensitive drum unit for forming a latent image by laser beams on the surface thereof. The photosensitive drum, by its nature, is damaged when exposed to a light source for an extended period of time. Additionally, the photosensitive drum is protected by a shutter because it may easily be scratched when it is separated from an image forming apparatus.

FIG. 1 is a perspective view of a typical laser printer as one example of an image forming apparatus. Referring to FIG. 1, the laser printer includes a photosensitive drum unit 2, which is detachably installed through a front door 5 of a printer main body 1. The photosensitive drum unit 2 includes a photosensitive drum 2*a* where a latent image is formed by laser beam exposure, and a shutter 2*b* for covering the photosensitive drum 2*a*. When the photosensitive drum unit 2 is installed into the printer main body 1, the shutter 2*b* should be opened so that the transfer roller 4 and the photosensitive drum 2*a* can come in contact with each other, and also so that laser beams can be scanned onto the photosensitive drum 2*a*. However, when the photosensitive drum unit 2 is separated from the main body 1, the shutter 2*b* should be closed to protect the photosensitive drum 2*a* from external shock. Sometimes, a user opens a side door 3 of the printer to remove jammed paper from a paper cassette 6 or replace a component. In this case, it is important that the shutter 2*b* remains closed to protect the photosensitive drum 2*a* against light coming from the outside. Thus, in a related art image forming apparatus, the shutter 2*b* is built to be opened and closed interlockingly with the opening and closing of the side door 3 of the printer so that when the side door 3 is opened, the shutter 2*b* closes, and vice versa.

In effect, a number of techniques for opening and closing the shutter of the photosensitive drum unit interlockingly with the side door of the main body of the image forming apparatus have been suggested. For instance, according to a laser printer disclosed in Korean Patent No. 395522 and as depicted in FIG. 2A, when a protrusion 3*a* on the side door 3 pushes a sliding member 11 to the right with the side door 3 closed, a pivotable bracket 2*c* of the photosensitive drum 2*a* is pushed in the direction indicated by the arrow "A" by a pivotable member 13 connected to a hinge, and the shutter 2*b* connected to the pivotable bracket 2*c* through a wire 2*d* is opened downwardly. In this state, the photosensitive drum 2*a* makes contact with a transfer roller 4, and the print operation is performed normally. On the other hand, when the side door 3 is opened, for instance, because of a paper jam, as shown in FIG. 2B, the transfer roller 4 and the photosensitive drum 2*a* are separated from each other, and the sliding member 11 is pressed by a spring 12, causing the pivotable member 13 to move in the direction indicated by the arrow "B". The pivotable bracket 2*c* of the photosensitive drum unit 2 is pulled by a tension spring 2*e*, and the shutter 2*b* connected to the pivotable bracket 2*c* through the wire 2*d* is closed upwardly. In this sliding mechanism, a relatively large space is required for opening/closing the shutter because the shutter of the photosensitive drum unit is opened and closed according to the motion of the pivotable member 13 and the wire 2*d*. A large space is also needed for the reciprocating motion of the sliding member 11.

FIG. 3 is a perspective view of another example of a related art photosensitive drum unit. In this case, the opening/closing of a shutter 220 according to the opening/closing of a side door 3 are done based on a totally different mechanism, i.e., a gear system. Unlike the photosensitive drum unit in FIG. 2, a photosensitive drum unit 200 in FIG. 3 is built in a manner that the shutter 220 is mounted on a long circular-shaped rotation axis 221, which is inserted into holes formed in a front and a rear supporter 203, 204, respectively, of a housing 201. A circular-shaped gear 211 is attached to one end of the rotation axis 221, and the gear 211 is also in mesh with a sector-shaped gear 210. The number of teeth of this sector-shaped gear 210 corresponds to the number of teeth required for the circular-shaped gear 211 to turn 360 degrees, or at least turned by a predetermined angle. Moreover, an arm 212 protrudes from one side of the sector-shaped gear 210, and a twist spring 207 is installed at a hinge shaft 208. One end of the twist spring 207 is connected to the sector-shaped gear 210, and the other end of the twist spring 207 is connected to the rear supporter 204 of the housing 201. According to the operational principle of this particular photosensitive drum unit 200, when the side door 3 is closed and the arm 212 of the sector-shaped gear 210 is pushed by a protrusion 3*a* protruding from the side door 3, the sector-shaped gear 210 rotates in the clockwise direction and causes the circular-shaped gear 211 to correspondingly rotate in the counterclockwise direction at the same time. As a result, the shutter 220 is opened upwardly. On the other hand, when the side door 3 is opened, the sector-shaped gear 210 returns to its original position by the twist spring 207, and the circular-shaped gear 211 also returns to its original position while rotating in the clockwise direction. The shutter 220 then closes downward to protect the drum 202.

In this gear system of FIG. 3, if the hinge shaft 208 of the side door 3 is mounted at a lower point of the side door 3, the radius of rotation of the side door 3 is increased, and therefore the length of a protrusion mounted at the side door also needs to be increased. A large installation space is therefore required for the shutter as long as the opening and closing of the shutter corresponds to the opening and closing of the side door. This fact makes it more difficult to manufacture a small-sized image forming apparatus.

SUMMARY OF THE INVENTION

Aspects of the present invention, therefore, solve at least the above problems and/or disadvantages of the dependency of opening and closing of a shutter on the opening and closing of a side door in a related art image forming apparatus, and provide at least the advantages described hereinafter.

It is, therefore, one aspect of the present invention to provide a photosensitive drum unit with an improved coupling structure, which enables a shutter to be opened and closed interlockingly with the opening and closing of a side door even in a narrow space. Another aspect of the present invention is to provide an image forming apparatus equipped with the above-described photosensitive drum unit.

To achieve the above aspects and advantages, there is provided a photosensitive drum unit, including: a photosensitive drum, a shutter having a rotation axis shaft which opens and closes to selectively enable access to the photosensitive drum, and a coupler, wherein a linear motion thereof causes a rotational motion of the shutter about the rotation axis shaft.

Preferably, the shutter is detachably mounted at a rotation axis, and the rotation axis is supported to be rotatable against a front and a rear supporter.

Preferably, the coupler is coupled to the rotation axis on the side of the rear supporter.

Preferably, the coupler opens/closes the shutter by rotating the rotation axis while sliding along the outer circumference of the rotation axis.

In an exemplary embodiment, the coupler includes: a cylindrical-shaped main body with one end blocked and a rib formed on the outer surface, which slides along the outer circumference of the rotation axis and has a curved guide that is formed by cutting out a part of the main body in a curve so as to guide a guide protrusion formed at one end of the rotation axis; and an elastic body inserted into the main body and mounted at a protrusion extended from the rotation axis.

Preferably, a suspension means is formed at the cylindrical-shaped main body to prevent an easy escape of the coupler from a cover of the rear supporter.

In an exemplary embodiment, the suspension means comprises: a connecting member extended from one side of an opening that is formed by cutting out a part of the cylindrical-shaped main body; and a hook formed at one end of the connecting member.

Preferably, the photosensitive drum unit further includes: a spring mounted at the rotation axis close to the front supporter side, wherein one end of the spring is connected to the front supporter and the other end of the spring is connected to the shutter.

Another aspect of the present invention includes an image forming apparatus, including: a photosensitive drum; a shutter having a rotation axis shaft and which opens and closes to selectively enable access to the photosensitive drum; a coupler, wherein a linear motion thereof causes a rotational motion of the shutter about the rotation axis shaft; and a pressing unit mounted at a support frame of the photosensitive drum unit which is pressably engageable with the coupler.

In an exemplary embodiment, the pressing unit includes: a locking member attached to a support frame of the photosensitive drum unit; a hinge shaft detachably mounted at the locking member; and a hinge bar connected by the hinge shaft.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
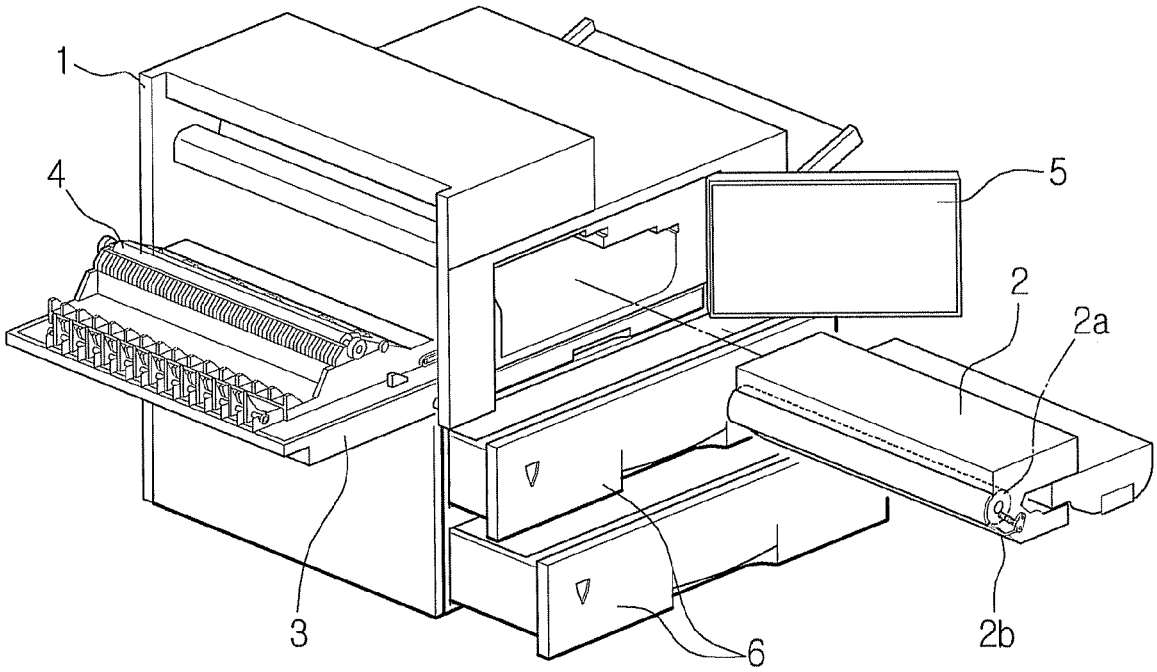
FIG. 1 (PRIOR ART)
FIG. 1 is a perspective view of a related art laser printer.
Figure 2A:
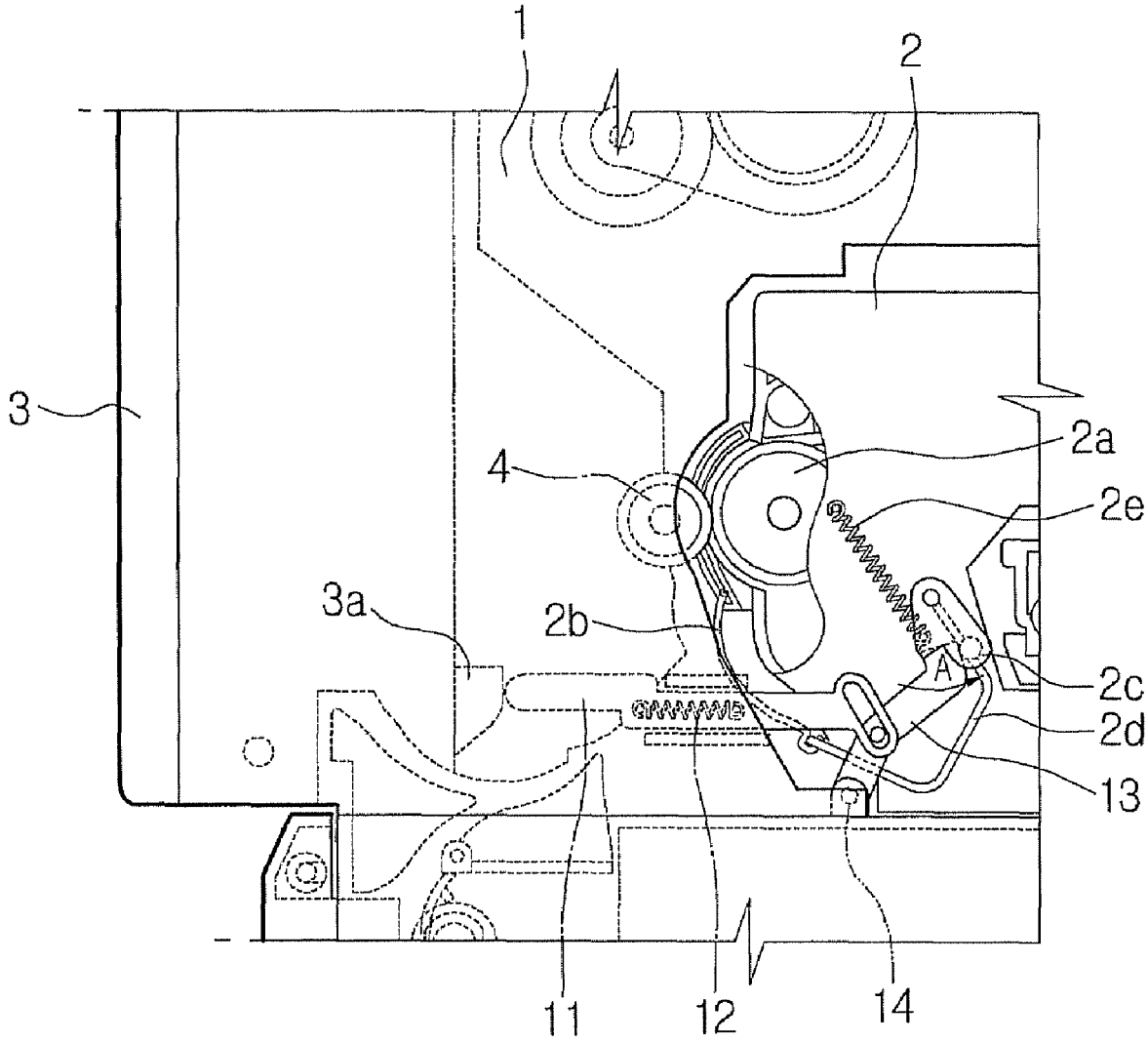
FIG. 2A (PRIOR ART)
FIG. 2A illustrates a state where a shutter of a photosensitive drum is closed.
Figure 2B:
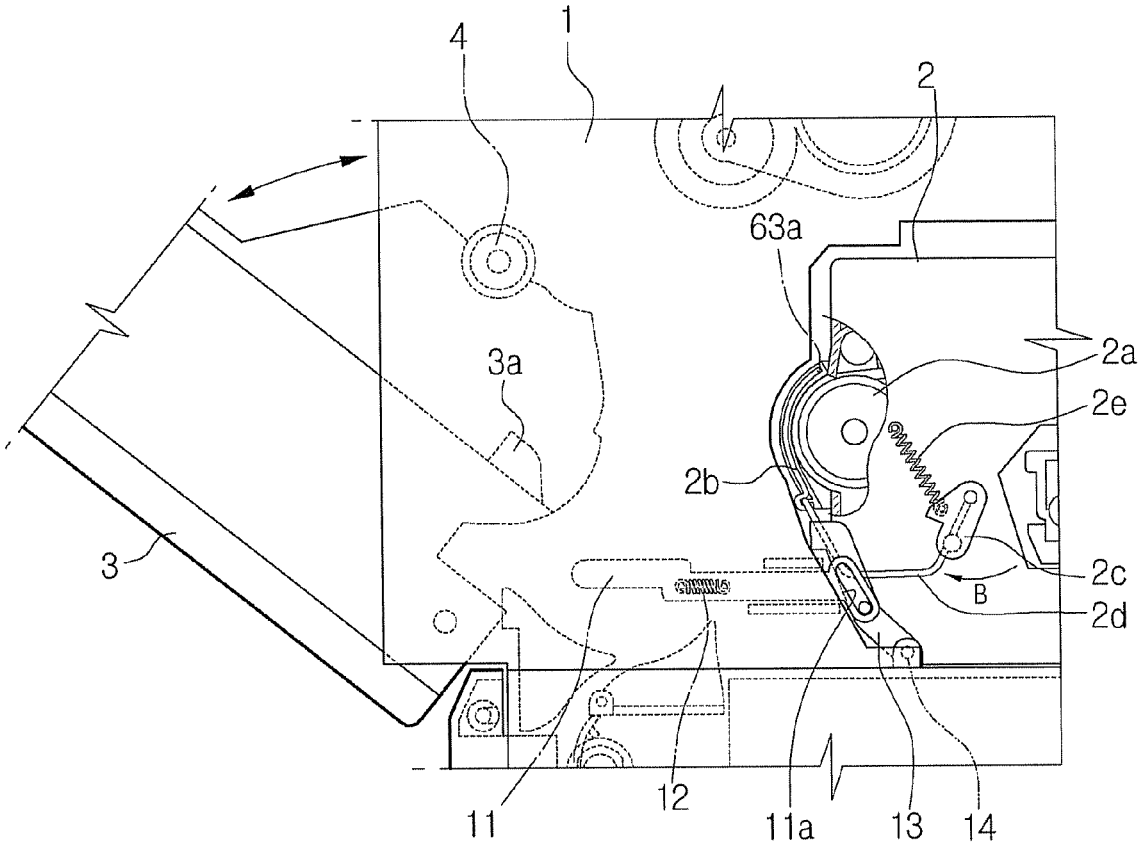
FIG. 2B (PRIOR ART)
FIG. 2B illustrates a state where a shutter of a photosensitive drum is opened.
Figure 3:
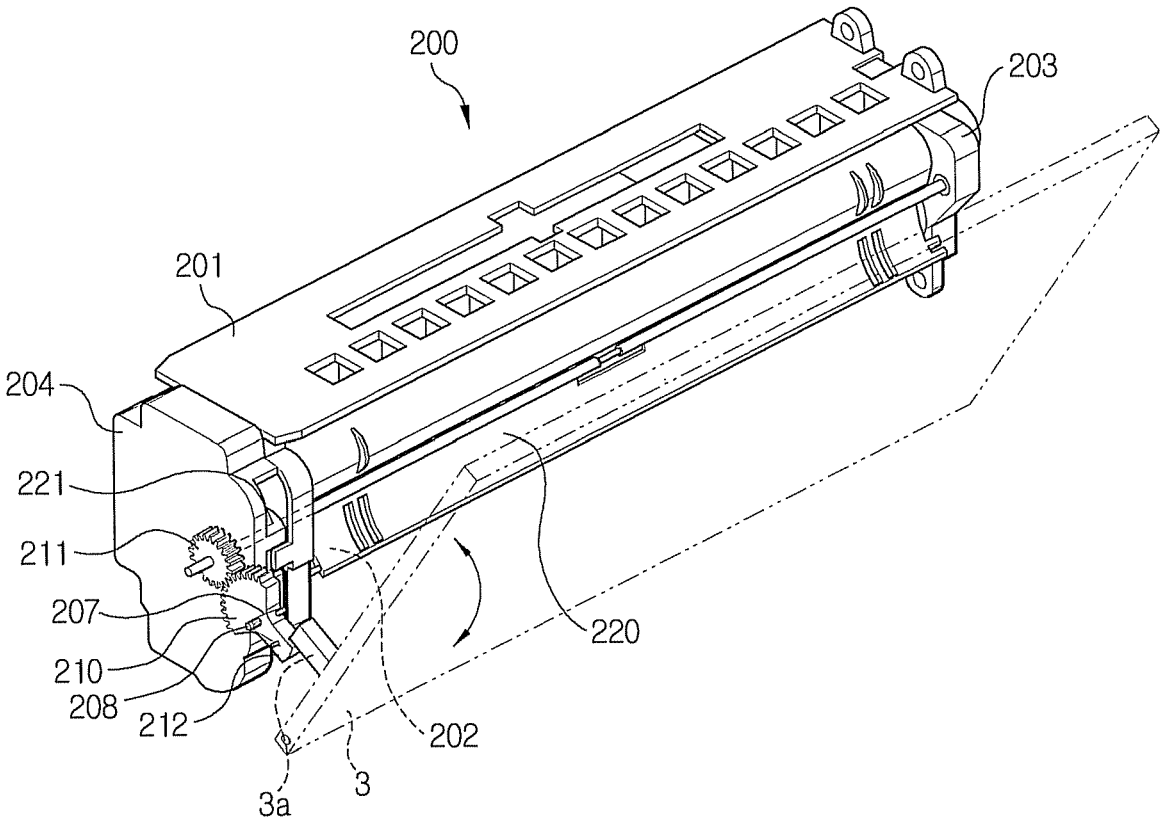
FIG. 3 (PRIOR ART)
FIG. 3 is a perspective view of another related art photosensitive drum unit.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 4:
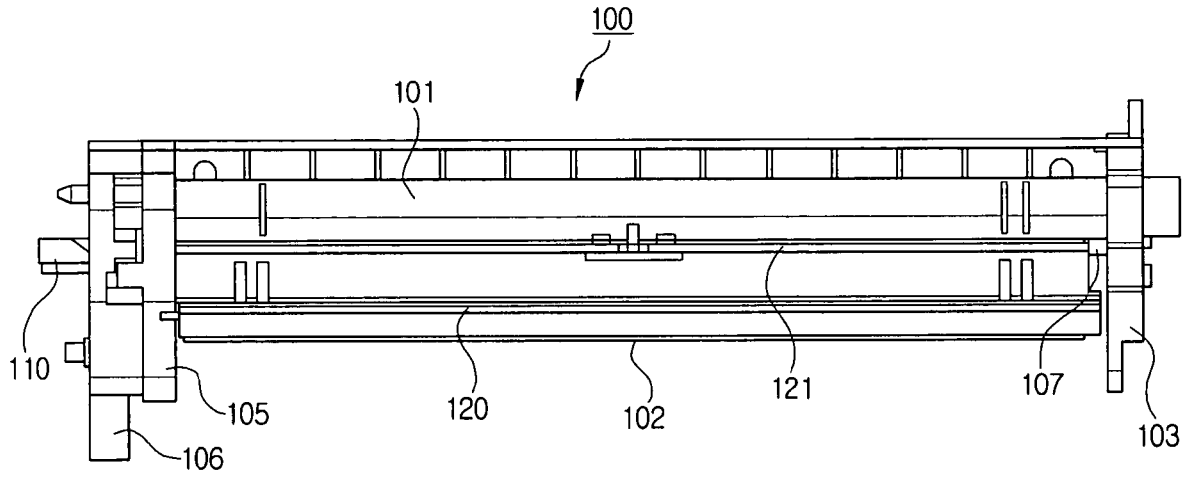
FIG. 4 is a front view of a photosensitive drum unit according to an embodiment of the present invention.
Figure 5:
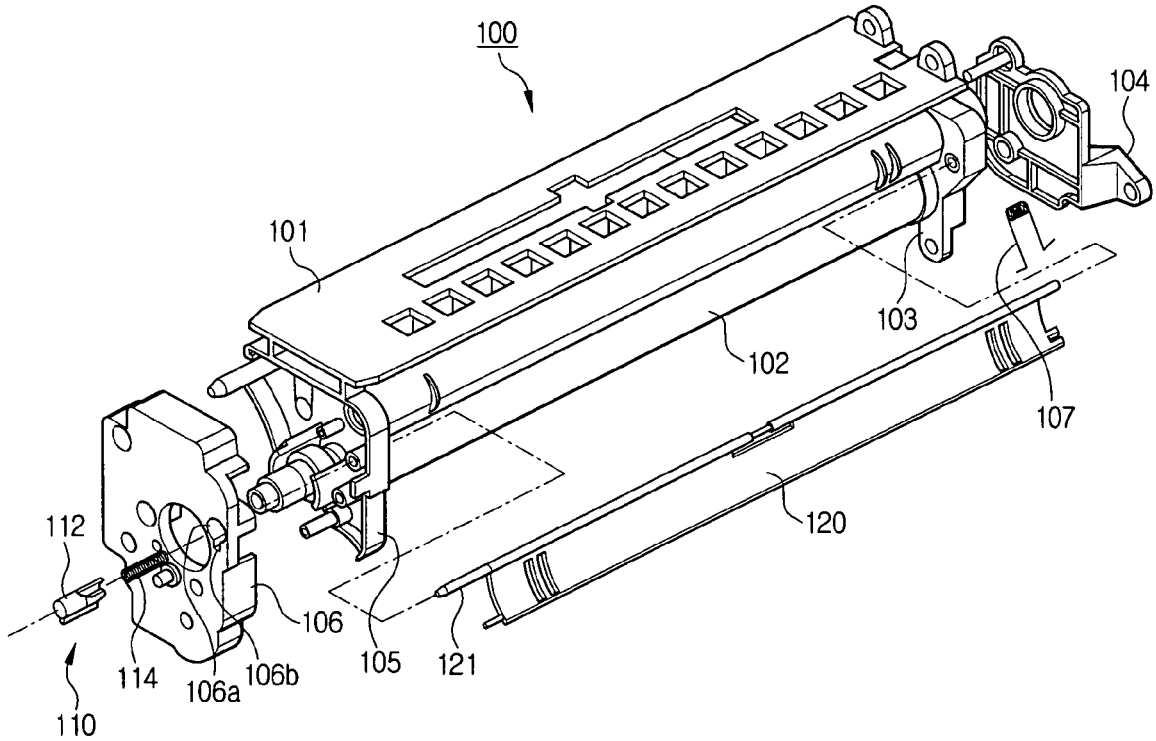
FIG. 5 is an exploded perspective view of FIG. 4.

FIG. 4 is a front view of a photosensitive drum unit according to an embodiment of the present invention, and FIG. 5 is an exploded perspective view of FIG. 4. As shown in FIGS. 4 and 5, the photosensitive drum unit includes a shutter 120 opened and closed by a coupler 110 which changes a straight line motion to a rotational motion, and a photosensitive drum 102 covered by the shutter 120 for protection.

In addition, a front and a rear supporter 103, 105, respectively, are formed on both ends of a housing 101, and the photosensitive drum 102 is disposed between these supporters 103, 105. Here, the drum 102 is rotatably linked to the front and rear supporters 103, 105, respectively.

The supporters 103, 105 are covered by front and rear covers 104, 106, respectively, and the photosensitive drum 102 is covered by the shutter 120 for protection.

The shutter 120 can be drawn into or out of a rotation axis 121 that is rotatably joined with the supporters 103, 105. In other words, the rotation axis 121 and the coupler 110 are coupled. Detailed views of a rear supporter 105 and a coupler 110 are shown in FIGS. 6, 7A and 7B, respectively.

Figure 6:
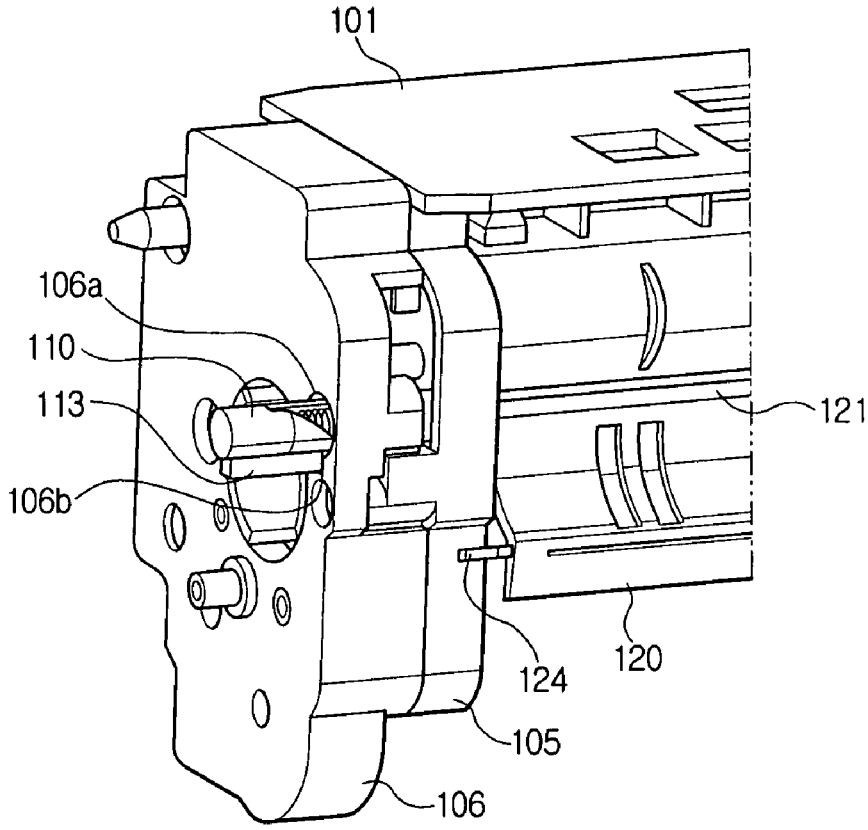
FIG. 6 is a detailed view of a rear supporter in FIG. 4.
Figure 7A:
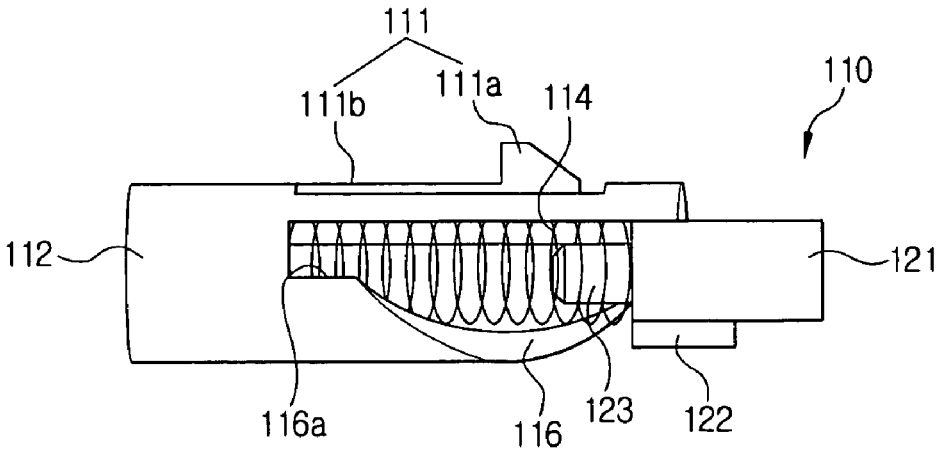
FIG. 7A is a front view of a coupler in FIG. 6.
Figure 7B:
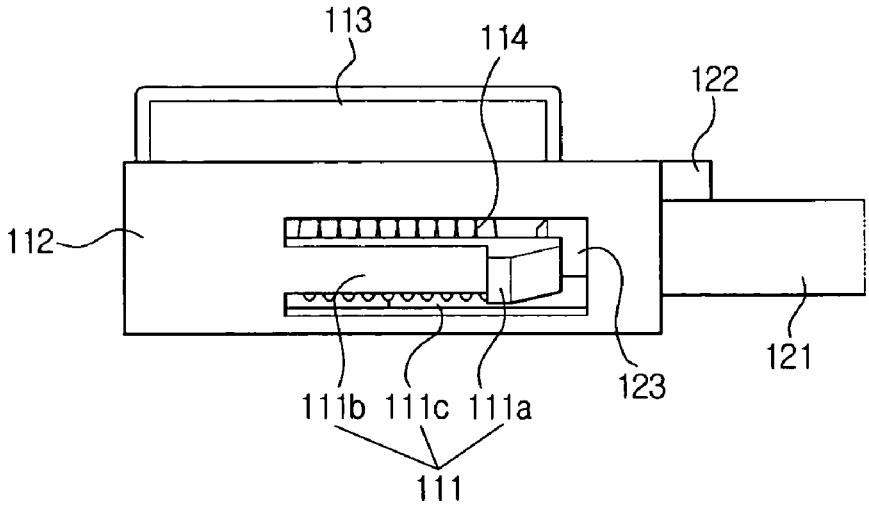
FIG. 7B is a plan view of the coupler in FIG. 6.

FIG. 6 is a detailed view of a rear supporter of the photosensitive drum unit. FIG. 7A is a front view of the coupler 110 and FIG. 7B is a plan view of the coupler 110. Referring to the drawings, the coupler 110 includes a main body 112 and an elastic member 114.

The main body 112 is a hollow cylinder, and one end thereof is blocked to push the elastic member 114. The main body has a curved guide 116 having a portion cut in a curve, and a guide protrusion 122 formed at one end of the rotation axis along the curved guide 116. The curved guide 116 has a spiral shape, and a space 116*a* for the guide protrusion 122 to rest is formed at the end portion. Therefore, when the coupler 110 performs a straight line motion, the guide protrusion 122 is guided along the curved guide 116 and the rotation axis 121 rotates. Furthermore, a rib 113 is formed on the outer surface of the main body 112. The rib 113 is inserted into an opening groove 106*b* of the rear cover 106. As such, although the rotation axis 121 of the shutter may rotate, the coupler 110 does not rotate but simply slides in a direction of the rotation axis 121.

The elastic member 114 is inserted into the main body 112. In detail, the elastic member 114 is oriented around an outer circumference of a protrusion 123 extended from the rotation axis 121. Preferably, a compression spring is used as the elastic member 114.

When the coupler 110 is driven by an external force it moves in a straight line motion inwardly (in a right direction of FIGS.6, 7A and 7B) along the rotation axis. As a result, the rotation axis 121 rotates, and the shutter 120 is rotated to an open position. When the external force is removed, the coupler 110 returns to its original position by the restoring force of the elastic member 114. In order to prevent the coupler 110 from escaping from the rear cover 106, a suspension unit 111 is preferably formed on the main body 112. The suspension unit 111 comprises a connecting member 111*b* extended from one side of an opening 111*c* that is formed by cutting out a part of the main body, and a hook 111*a* formed at one end of the connecting member 111*b*. To make the coupler 110 easily insertable into but not easily drawn out of the rear cover 106, one side of the hook 111*a* is preferably rounded and the other side of the hook 111*a* has a hook shape.

In short, because of the suspension unit 111, the coupler 110 can be easily inserted into a hole 106*a* of the cover 106 for the rear supporter 105, and does not easily get drawn out of the hole 106*a*. Although it is preferable to have the suspension unit with one side having a round shape and the other side having a hook shape, the sides of the suspension unit can be designed in any number of shapes.

Figure 8:
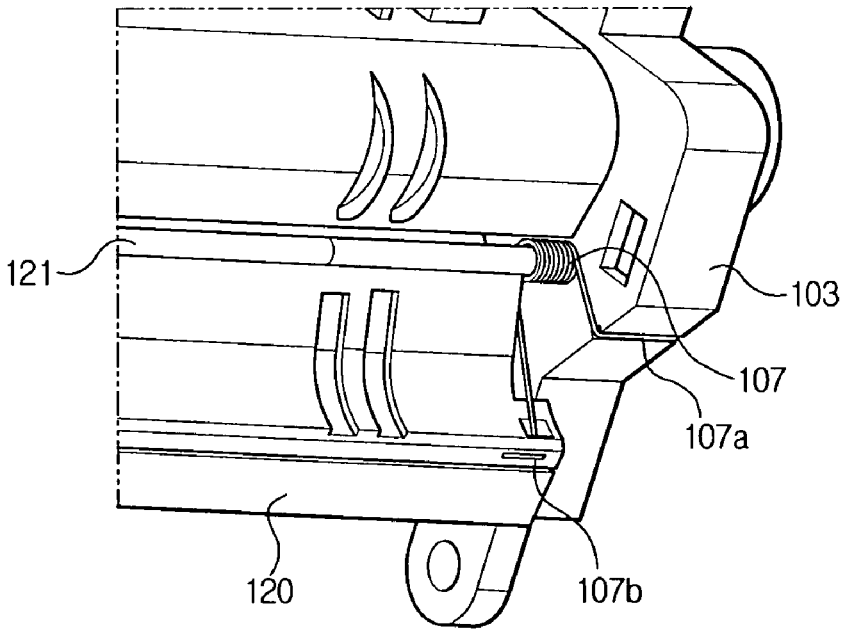
FIG. 8 is a detailed view of a front supporter in FIG. 4.

FIG. 8 is a detailed view of the front supporter side 103 in the photosensitive drum unit 100. Referring to the drawing, a spring 107 is mounted at the rotation axis 121 on the front supporter side 103. That is, one end 107*a* of the spring is connected to the front supporter 103, whereas the other end 107*b* of the spring is connected to the shutter 120. This spring 107, located on the front supporter side 103 of the photosensitive drum unit 100, balances the force caused by the elastic member 114 located on the rear supporter side 105 of the photosensitive drum unit 105. Although a spring is preferable, anything capable of applying force on the shutter 120 may be used to balance the force of the elastic member 114.

An image forming apparatus according to another aspect of the present invention includes the photosensitive drum unit 100 described above. Besides the photosensitive drum unit 100, the image forming apparatus of the invention includes a pressing unit 130 mounted at a support frame 108 of the photosensitive drum for pressing the coupler 110, and a side door 30 with a protrusion 134 that comes in contact with the pressing unit 130 when the side door 30 is closed.

The pressing unit is installed in a narrow space between the photosensitive drum unit 100 and a printer main body 1. The pressing unit may take any shape or pattern as long as it is able to press one side of the coupler.

Figure 9:
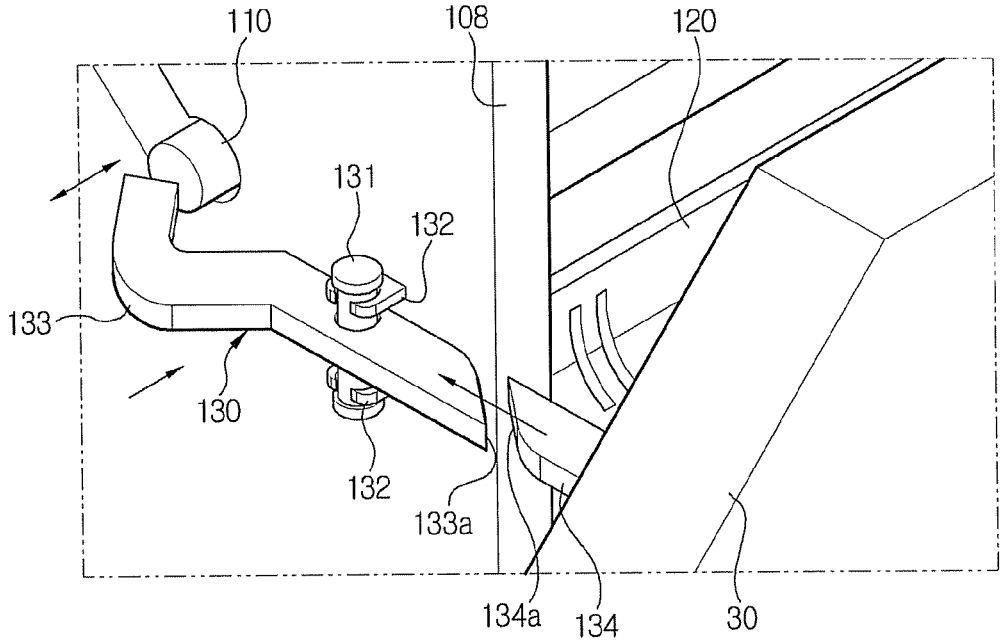
FIG. 9 is a perspective view of a coupler pressing unit according to an embodiment of the present invention.

FIG. 9 shows an embodiment of the pressing unit for the coupler, according to an aspect of the present invention. As depicted in FIG. 9, the pressing unit 130 comprises a locking member 132 attached to a support frame 108 of the photosensitive drum unit 100, a hinge shaft 131 detachably mounted at the locking member 132, and a hinge bar 133 connected to the support frame 108 by the hinge shaft 131.

When the side door 30 is closed, a protrusion 134 of the side door 30 comes in contact with the hinge bar 133 of the pressing unit 130, and the hinge bar 133 pivots around the hinge shaft 131 and presses the coupler 110. Preferably, the front side 134*a* of the protrusion 134 of the side door 30 makes contact with the front side 133*a* of the hinge bar 133.

With reference to drawings, the following description explains the operation of the image forming apparatus according to the preferred embodiment of this aspect of the present invention, and more specifically, the operation of the pressing unit 130.

Figure 10:
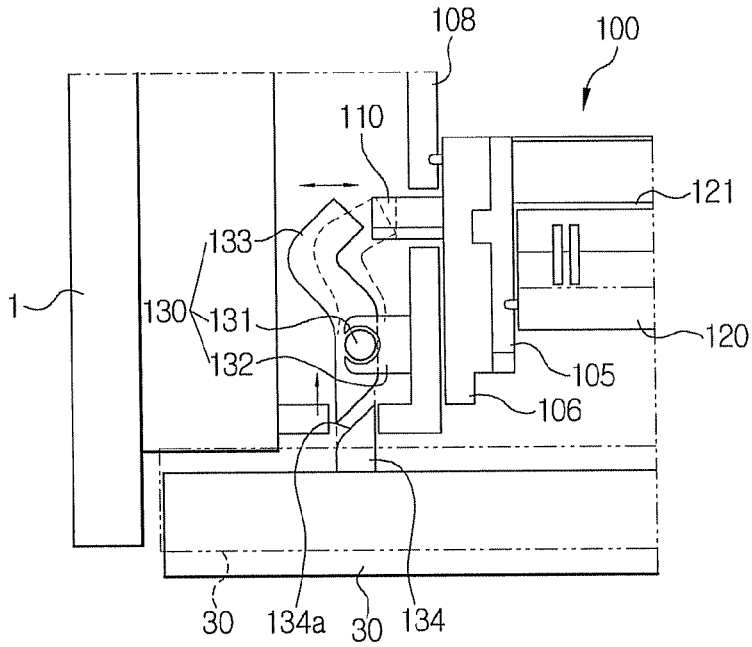
FIG. 10 illustrates an operational state of a side door and a coupler in an image forming apparatus according to an embodiment of the present invention.
Figure 11A:
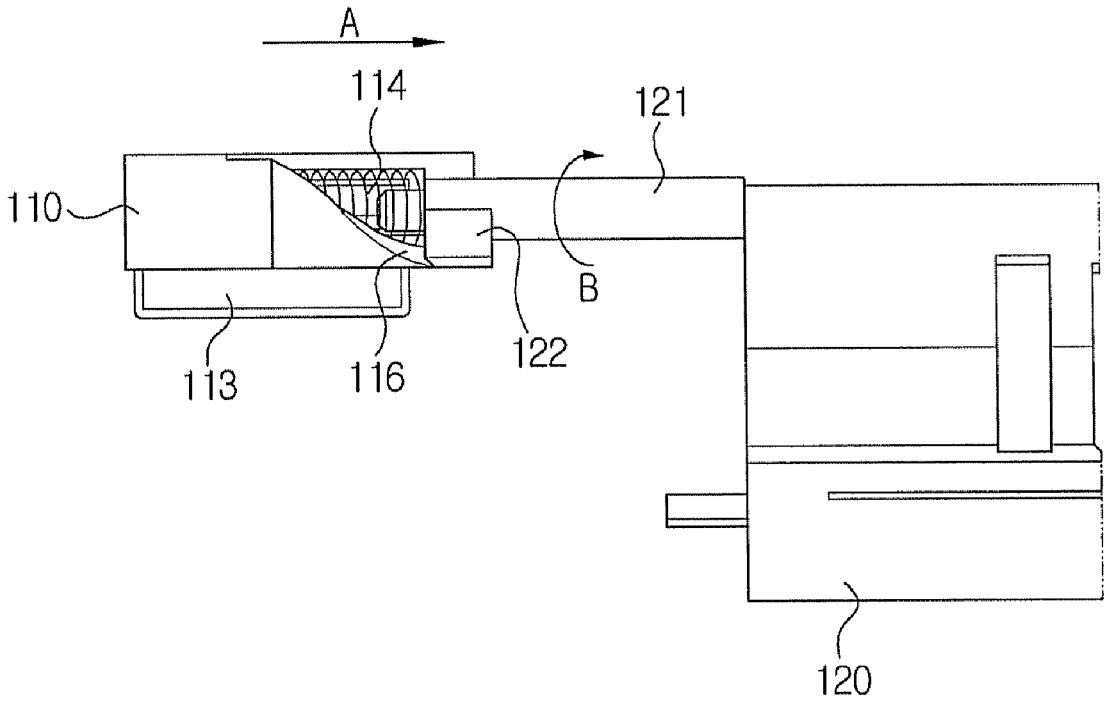
FIG. 11A illustrates an operational state of a shutter and a coupler when the shutter is closed.
Figure 11B:
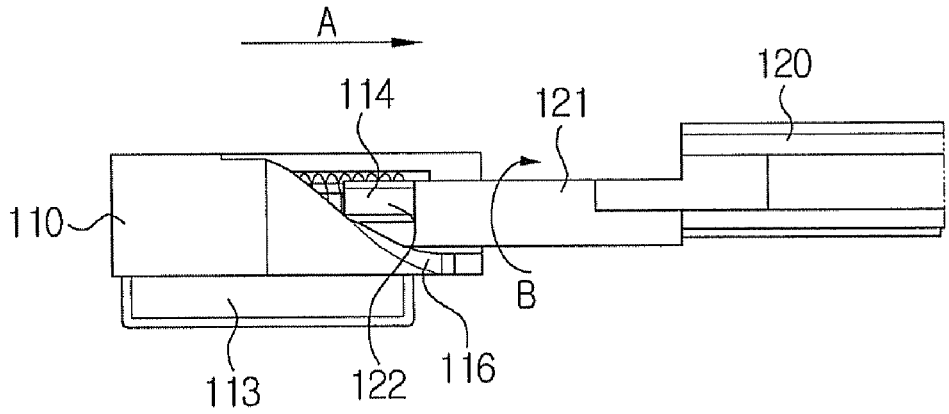
FIG. 11B illustrates an operational state of a shutter and a coupler when the shutter is partially open.
Figure 11C:
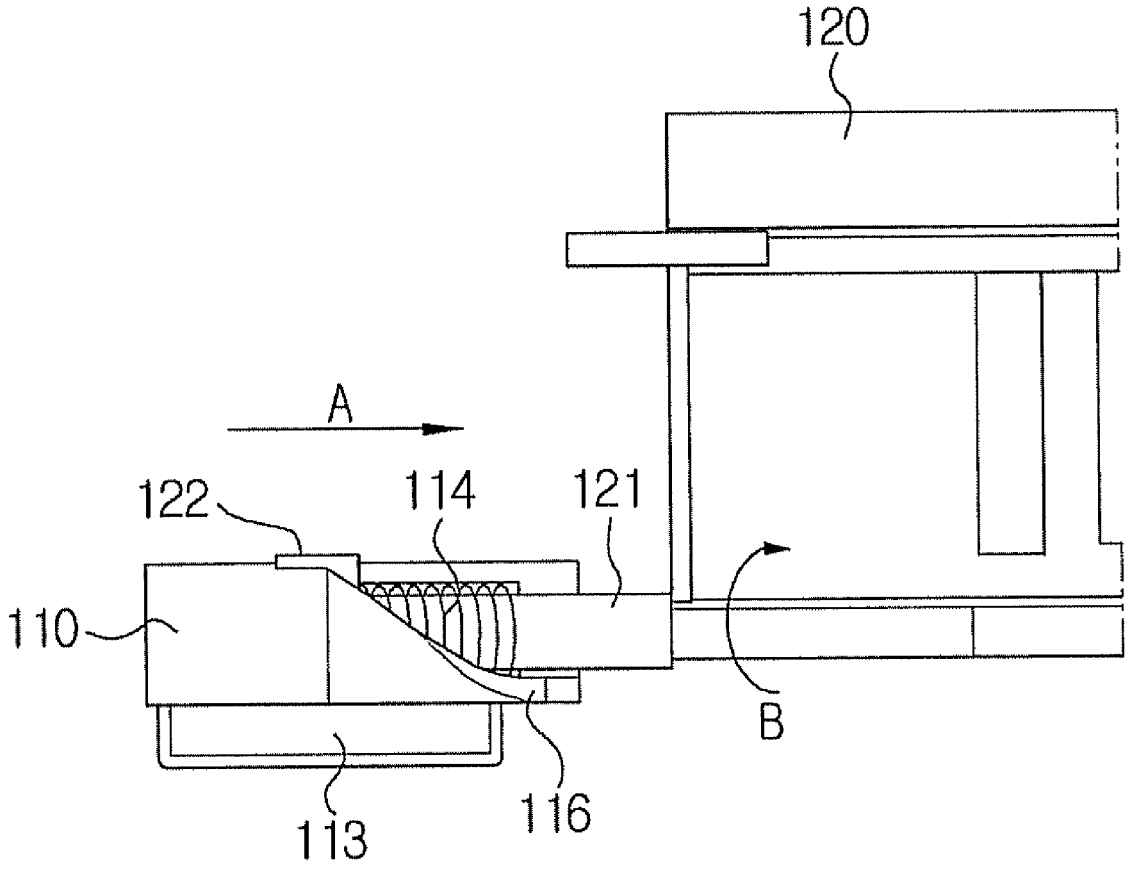
FIG. 11C illustrates an operational state of a shutter and a coupler when the shutter is open.

FIG. 10 illustrates an operational state of the side door and the coupler in the image forming apparatus according to an embodiment of the present invention, and FIGS. 11A through 11C illustrate operational states of the shutter and the coupler. As shown in FIG. 10, when the side door 30 is closed, the protrusion 134 of the side door 30 pushes the hinge bar 133 of the pressing unit 130, and the hinge bar 133 pivots around the hinge shaft 131, thereby pressing the coupler 110.

As a result of the hinge shaft 131 pressing the coupler 110, the coupler 110 slides along the outer circumference of the rotation axis 121 in the "A" direction, as shown in FIGS. 11A to 11C. In the course of sliding, the rib 113 of the coupler 110 remains inserted into the opening groove 106*b* (shown in FIG. 6) of the rear cover 106 (shown in FIG. 6), so the coupler 110 does not rotate while the guide protrusion 122 of the rotation axis 121 moves along the curved guide 116 of the coupler 110. As a result, the rotation axis 121 rotates in the "B" direction and the shutter 120 is opened. While the shutter 120 is opened, the normal operation of the image forming apparatus can be performed, e.g., scanning laser beams onto the photosensitive drum unit.

On the other hand, when the side door 30 is opened, the protrusion 134 of the side door 30 is separated from the hinge bar 133 of the pressing unit 130, and the coupler 110 is pushed back to its original position (as shown in FIG. 11A) by the elastic member 114. At this point, the rotation axis 121 is guided along the curved guide 116 by means of the guide protrusion 122 and as a result, the shutter 120 closes.

Since the shutter 120 is closed not only by force of the elastic member 114 but also by the force of the spring 107 mounted at the rotation axis 121 on the side of the front supporter 103, the forces acting on both sides of the shutter 120 can be balanced, stabilizing the opening and closing motion of the shutter.

Above all, the present invention is advantageous in that the coupling structure for opening and closing the shutter interlockingly with the side door is very simple and can be installed in a very narrow space. As aforementioned, in a related art, if the radius of rotation is large because the rotation hinge point of the side door is positioned at a lower point, the length of the protrusion of the side door had to be correspondingly increased. This corresponding increase was troublesome for securing a sufficient installation space for the coupling structure. However, the problem can be solved through the simple coupling structure suggested by the present invention.

In conclusion, by making the coupler control the opening and closing of the shutter, the photosensitive drum unit according to aspects of the present invention has a very simple structure, and therefore can easily be installed in a narrow space.

Moreover, the image forming apparatus according to the present invention features a smooth opening and closing motion of the shutter, and additionally may have a small size which requires a reduced installation space.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A photosensitive drum unit, comprising:

a photosensitive drum;

a shutter having a rotation axis shaft which opens and closes to selectively enable access to the photosensitive drum; and a coupler, wherein a linear motion of the coupler along and parallel to the rotation axis shaft causes a rotational motion of the shutter about the rotation axis shaft.

2. The photosensitive drum unit according to claim 1, wherein:

the rotation axis shaft is supported on one side by a front supporter and on another side by a rear supporter, the shutter is detachably mounted to the rotation axis shaft, and the coupler is coupled to the rotation axis shaft on the side of the rear supporter.

3. The photosensitive drum unit according to claim 2, wherein:

the coupler rotates the rotation axis shaft while sliding along an outer circumference of the rotation axis shaft.

4. The photosensitive drum unit according to claim 3, wherein the coupler comprises:

a cylindrical-shaped main body with one end blocked and a rib formed on an outer surface;

a curved guide that causes a guide protrusion, formed at one end of the rotation axis shaft, to move in a rotational motion about the outer circumference of the rotation axis shaft and thereby causes the shutter to open and close; and an elastic body inserted into the cylindrical-shaped main body and mounted at the guide protrusion, which pushes the cylindrical-shaped main body away from the rotation axis shaft.

5. The photosensitive drum unit according to claim 4, wherein the cylindrical-shaped main body slides along the outer circumference of the rotation axis shaft.

6. The photosensitive drum unit according to claim 5, wherein the curved guide is formed by cutting out a part of the cylindrical-shaped main body in a curve.

7. The photosensitive drum unit according to claim 6, wherein the cylindrical-shaped main body has a suspension unit formed at the cylindrical-shaped main body which prevents an escape of the coupler from a cover of the rear supporter.

8. An image forming apparatus, comprising:

a photosensitive drum unit, comprising, a photosensitive drum;

a shutter having a rotation axis shaft and which opens and closes to selectively enable access to the photosensitive drum;

a coupler, wherein a linear motion of the coupler along and parallel to the rotational axis shaft causes a rotational motion of the shutter about the rotation axis shaft; and a pressing unit mounted at a support frame of the photosensitive drum unit which is pressably engageable with the coupler to move the coupler along the direction of the rotation axis shaft.

9. The apparatus according to claim 8, wherein the pressing unit comprises:

a locking member attached to the support frame of the photosensitive drum unit;

a hinge shaft detachably mounted at the locking member; and a hinge bar connected to the support frame by the hinge shaft, wherein the hinge bar is pressed into the coupler by a protrusion extending from a side door.

10. The apparatus according to claim 9, wherein:

the rotation axis shaft is supported on one side by a front supporter and on another side by a rear supporter, the shutter is detachably mounted to the rotation axis shaft, and the coupler is coupled to the rotation axis shaft on the side of the rear supporter.

11. The apparatus according to claim 10, wherein:

the coupler rotates the rotation axis shaft while sliding along an outer circumference of the rotation axis shaft.

12. The apparatus according to claim 11, wherein the coupler comprises:

a cylindrical-shaped main body with one end blocked and a rib formed on an outer surface;

a curved guide that causes a guide protrusion, formed at one end of the rotation axis shaft, to move in a rotational motion about the outer circumference of the rotation axis shaft and thereby causes the shutter to open and close; and an elastic body inserted into the cylindrical-shaped main body and mounted at the guide protrusion, which pushes the cylindrical-shaped main body away from the rotation axis shaft.

13. The apparatus according to claim 12, wherein the cylindrical-shaped main body slides along the outer circumference of the rotation axis.

14. The apparatus according to claim 12, wherein the cylindrical-shaped main body has a suspension unit formed at the cylindrical-shaped main body which prevents an escape of the coupler from a cover of the rear supporter.

15. The apparatus according to claim 14, wherein the suspension unit comprises:

a connecting member extending from one side of an opening in the cylindrical-shaped main body; and a hook formed at one end of the connecting member.

16. A photosensitive drum unit, comprising:

a photosensitive drum rotatably inserted between a front supporter and a rear supporter mounted at both ends of a housing; and a shutter rotatably mounted at a rotation axis shaft that is rotatable against the front and rear supporters, and covering the photosensitive drum for protection, wherein a coupler slides in a linear motion parallel to a direction of and along an outer circumference of the rotation axis shaft and causes the rotation axis shaft to rotate, thereby causing the shutter to rotate.

17. The photosensitive drum unit according to claim 16, wherein the coupler comprises:

a cylindrical-shaped main body with one end blocked and a rib formed on an outer surface;

a curved guide that causes a guide protrusion, formed at one end of the rotation axis shaft, to move in a rotational motion about the outer circumference of the rotation axis shaft and thereby causes the shutter to open and close; and an elastic body inserted into the cylindrical-shaped main body and mounted at a protrusion extended from the rotation axis shaft which pushes the cylindrical-shaped main body away from the rotation axis shaft.

18. The photosensitive drum unit according to claim 17, wherein the cylindrical-shaped main body has a suspension unit formed at the cylindrical-shaped main body which prevents an escape of the coupler from a cover of the rear supporter.

19. The photosensitive drum unit according to claim 18, wherein the suspension unit comprises:

a connecting member extending from one side of an opening in the cylindrical-shaped main body; and a hook formed at one end of the connecting member.

20. A photosensitive drum unit, comprising:

a shutter having a rotational axis shaft;

a guide fixed to an end of the rotation axis shaft; and a coupler which slides a linear distance parallel to the rotation axis shaft to force the guide to move a rotatable distance which is greater than the linear distance such that the guide rotates the shutter about the rotational axis shaft.

* * * * *